United States Patent [19]

Fischer et al.

[11] Patent Number: 4,766,793

[45] Date of Patent: Aug. 30, 1988

[54] KNIFE ASSEMBLY FOR A WATER GUN

[75] Inventors: Robert R. Fischer, Michigan City; Eugene H. Cole, Valparaiso, both of Ind.

[73] Assignee: Urschel Laboratories, Inc., Valparaiso, Ind.

[21] Appl. No.: 59,859

[22] Filed: Jun. 8, 1987

[51] Int. Cl.[4] ..... B26D 1/03; B26D 3/26

[52] U.S. Cl. ..... 83/698; 83/402; 83/404.4; 83/857

[58] Field of Search ..... 83/402, 404.4, 698, 83/857

[56] References Cited

U.S. PATENT DOCUMENTS 2,487,431 11/1949 Floyd ..... 83/857 X 4,082,024 4/1978 Hodges et al. ..... 83/402

*Primary Examiner*—Frank T. Yost

*Attorney, Agent, or Firm*—Bacon & Thomas

[57] ABSTRACT

A knife assembly for a water gun wherein each slot in the blade portion of each knife element for engagement within a corresponding slot in the base portion of an adjacent knife is configured to diverge outwardly towards the cutting edge so that bending of the cutting edge corner portions of the slot due to twisting of the adjacent knife during the cutting operation is prevented.

16 Claims, 5 Drawing Sheets

PRIOR ART
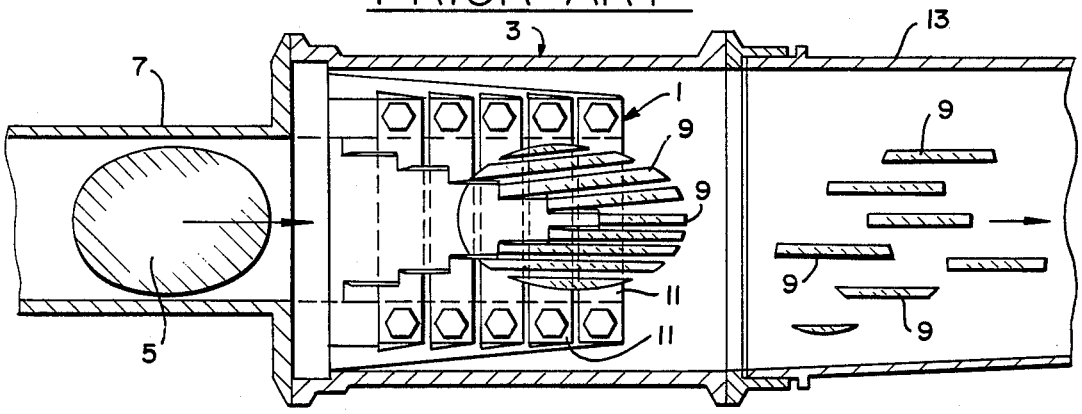
FIG 2
FIG 3
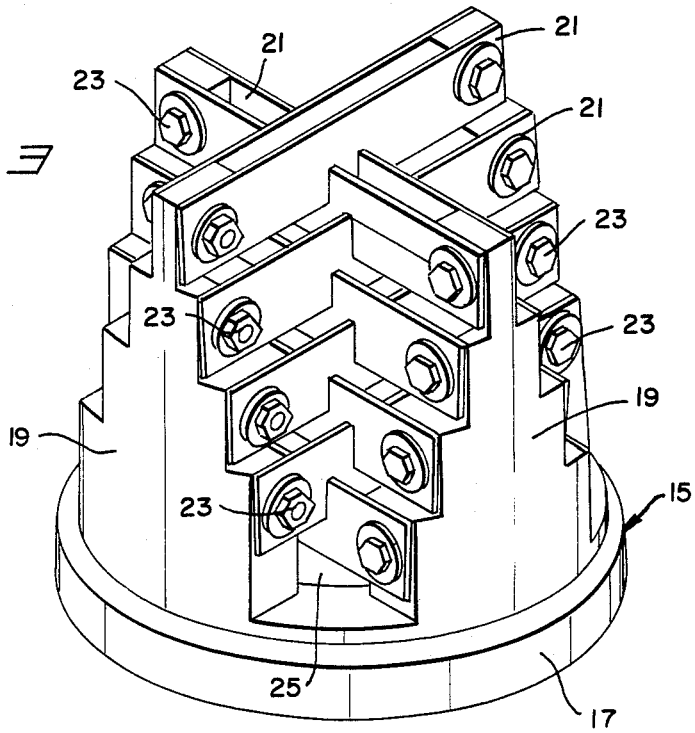
PRIOR ART

PRIOR ART

KNIFE ASSEMBLY FOR A WATER GUN

BACKGROUND OF THE INVENTION

1. Field of the Invention

The invention generally involves the field of technology pertaining to apparatus for cutting agricultural products into reduced size portions. More specifically, the invention relates to an improved knife assembly for use in a water gun whereby potato strips may be cut from whole potatoes for the production of french fries.

2. Description of the Prior Art

Hydraulic cutting systems are well known in the art for cutting or slicing agricultural products, particularly potatoes into slabs or strips. A system of this type is often referred to as a water gun and operates by pumping a mixture of water and the product to be cut through a pipe. The product is propelled at a fairly high rate of speed and caused to impact against a stationary knife assembly which cuts the product into the required size portions during its travel through the pipe. The resulting mixture of water and cut product is then discharged for separating the product from the water. In the production of french fries, such a system is generally capable of propelling the water and potato mixture through the knife assembly at approximately 55 feet per second and realize a production capacity of approximately 1000 pounds per minute.

The stationary knife assembly utilized in a typical water gun is defined by a cutting head block onto which a plurality of elongate knife elements are secured in parallel pairs that are disposed in a staggered relationship and at a 90° offset with respect to adjacent pairs of knife elements. The cutting edge of the knife elements therefore collectively define a plurality of rectangular-shaped boxes for producing strips of the product having corresponding transverse cross-sectional configurations. The interengagement of adjacent knife elements is accomplished by providing each knife element with at least one open slot in its base portion and at least one open slot in its blade portion so that the blade portion of one knife element may be interengaged within the corresponding base portion slot of an adjacent knife element. The knife elements disposed at the furthermost upstream end of the head block are only provided with slots in their base portions, while the knife elements disposed at the furthermost downstream end of the head block are only provided with slots in their blade portions.

During the cutting operation, the high speed at which the product is impacted against the knife assembly and the often asymmetrical configuration of the product being cut tend to impart considerable stress to the individual knife elements of the assembly, particularly when the product does not impact directly at the center of the assembly. This stress results in a twisting of the knife elements from side to side, which in turn results in the bending of the sharp cutting edge corner portions of the slots in the blade portions of the knife elements. When this occurs, the resulting bent corner portions tear the sides of the potato strips as they are being cut, thereby producing an inferior product. Moreover, the bent corner portions also impair the proper sharpening of the knife elements after they become dull, and require that the affected knife elements be either repaired or discarded.

Some examples of water guns utilizing stationary knife assemblies of the type described herein are disclosed by the Lamb et al U.S. Pat. No. 3,116,772; Hodges et al U.S. Pat. No. 4,135,002; and Winslow U.S. Pat. No. 4,423,652.

SUMMARY OF THE INVENTION

It is an object of the present invention to provide an improved knife assembly for a water gun whereby a variety of articles and products may be cleanly and rapidly cut into strips of consistent configuration and size.

It is another object of the invention to provide an improved knife assembly for a water gun which is capable of cutting agricultural products into strips at high production rates without tearing the sides of the strips as they are being cut.

It is still another object of the invention to provide an improved knife assembly for the cutting of potatoes into strips for the production of french fries.

It is a further object of the invention to provide an improved knife element for the knife assembly of a water gun wherein the knife element may be easily resharpened and has longevity in use.

These and other objects of the invention are realized by providing an improved knife assembly for a water gun wherein each knife element of the assembly having open slots in its blade portion for interengagement within corresponding open slots in the base portion of an adjacent knife element is provided with blade portion slots which diverge outwardly. The divergence of each slot being preferably defined by a pair of opposed bevels angled at approximately 10° from parallel sidewall portions of the slot.

Other objects, advantages and features of the invention shall become apparent from the following detailed description of a preferred embodiment thereof when taken in conjunction with the drawings wherein like reference characters refer to corresponding parts of the several views.

BRIEF DESCRIPTION OF THE DRAWINGS

FIG. 2 is a fragmentary cross-sectional view showing the disposition of a stationary knife assembly utilized in the system depicted in FIG. 1;

FIG. 3 is a perspective view of the knife assembly depicted in FIG. 2;

DETAILED DESCRIPTION OF THE INVENTION

A conventional water gun system shall now be described with initial reference to FIG. 1. As shown therein, the product to be cut is conveyed to a supply hopper from which it is propelled by water pumped through a conduit. The water and product mixture is initially driven through a converging portion of the conduit which serves to accelerate this mixturee for impact against a stationary knife assembly, shown circled, which cuts the product traveling at high speed into strips. The water and cut product mixture then pass through a diverging portion of the conduit which serves to reduce the speed of the mixture. The mixture is then directed to a separation station, usually in the form of a dewatering screen, at which the water is separated from the cut product and recycled to the product supply station. The cut product is then discharged for subsequent processing.

Figure 1:
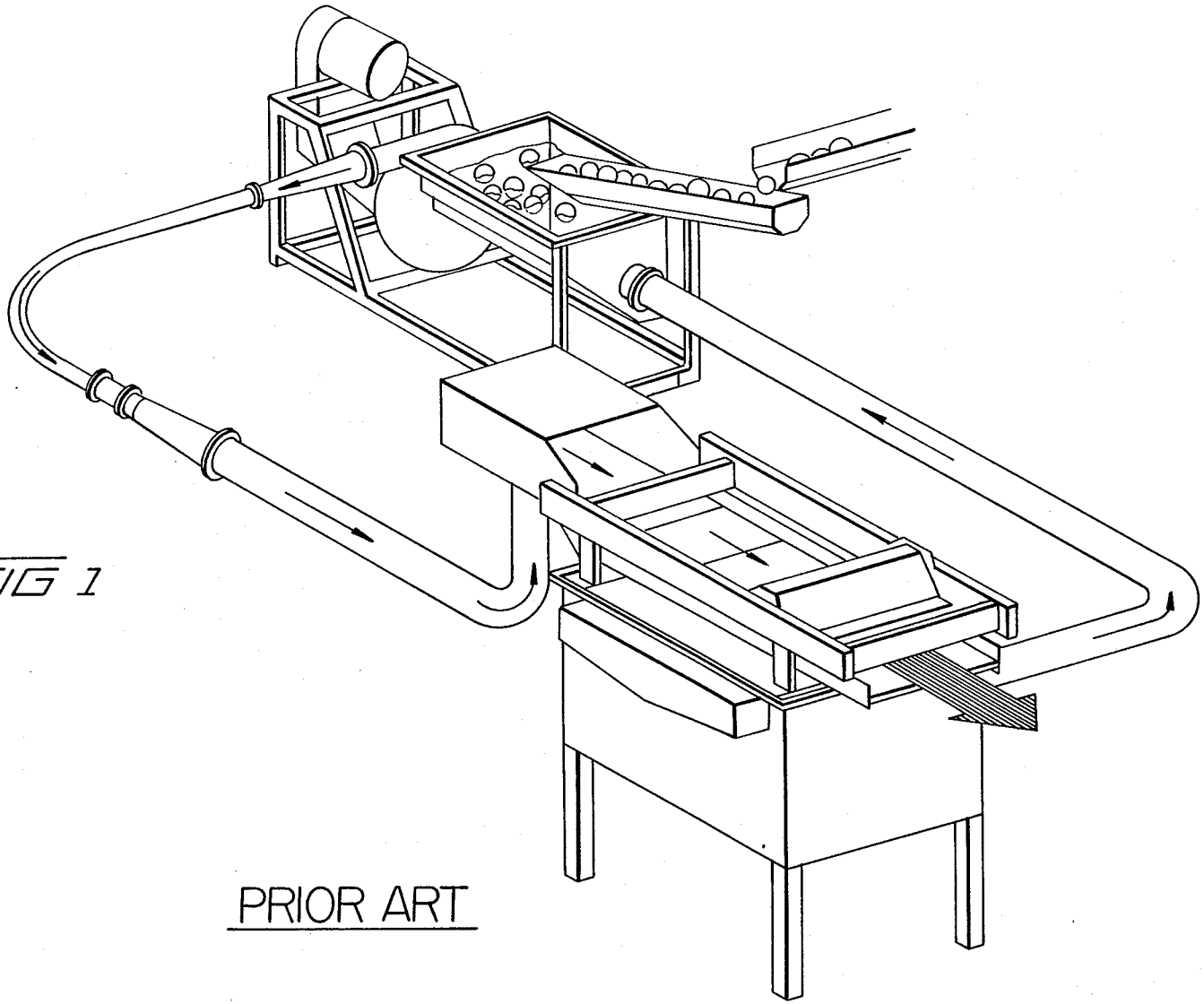
PRIOR ART FIG 1
FIG. 1 is a diagrammatic perspective view of a conventional water gun system, wherein the essential components of the system from the initial product supply station to the cut product discharge station are depicted.

With reference now to FIG. 2, a stationary knife assembly 1 is shown disposed within a conduit 3 of a water gun system of the type previously described and shown in FIG. 1. A product 5, such as a potato, is accelerated through an input section 7 of conduit 3 through its entrainment in water pumped therethrough. Product 5 is caused to impact against knife assembly 1 and caused to be sliced or cut into a plurality of strips 9, the cross-sectional configuration of each strip 9 being predetermined by the disposition and configuration of a plurality of knife elements 11 forming assembly 1. Strips 9 are thereafter discharged into a downstream section 13 of conduit 3 within which it is decelerated prior to being directed to the separation station. As apparent from FIG. 2, the diameter of downstream section 13 is larger than the diameter of upstream section 7 of conduit 3, the difference and relative sizes thereby permitting the deceleration of product 5 and strips 9 thereof.

The details of knife assembly 1 shall now be described with reference to FIG. 3. Assembly 1 is comprised of a cutting head block 15 that includes a circular base 17 and a plurality of stepped supports 19 extending from base 15. In the configuration shown, four supports 19 are circumferentially spaced 90° apart on base 15. A plurality of knife elements 21 are rigidly secured to supports 19 by a plurality of bolt assemblies 23 or other suitable mechanical fasteners. As apparent from FIG. 3, pairs of parallel knife elements 21 are secured to supports 19 in a staggered crisscross configuration, wherein each pair of knife elements 21 are disposed at 90° offset with respect to an immediate adjacent pair of elements 21. Each knife element 21 is of elongate configuration, with bolt assemblies 23 passing through the opposed ends of elements 21 and corresponding portions of supports 19. As also evident, the disposition of knife elements 21 on supports 19 serve to collectively define a plurality of rectangular-shaped cutting sections which correspond to the desired cross-sectional size and configuration of the resulting product strips 9. Product 5 enters knife assembly 1 through a generally circular-shaped inlet opening 25 formed in base 17 of block 15. Knife elements 21 closest to opening 25 define the leading or upstream knife elements, while knife elements 21 farthest from opening 25 define the trailing or downstream knife elements. Assembly 1 as shown in FIG. 3 is of the type manufactured and sold by Urschel Laboratories, Inc. of Valparaiso, Ind. 46384-2200 under the trademark FLOW-CUT ®.

Figure 5:
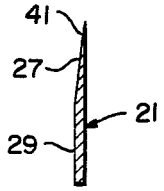
FIG 5 PRIOR ART
FIG. 5 is a cross-sectional view taken along the line 5—5 of FIG. 4.
Figure 6:
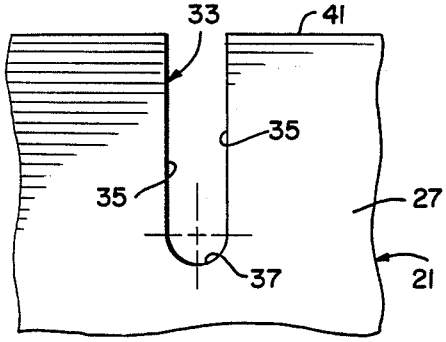
FIG. 6 is a fragmentary view of an open slot in the blade portion of the knife element of FIG. 4.

The particular details of knife element 21 shall now be described with reference to FIGS. 4–6. Knife element 21 is substantially of an elongate rectangular configuration and includes a sharpened longitudinal blade portion 27 and a longitudinal base portion 29. The opposed ends of element 21 are provided with a pair of apertures 31 sized for receiving bolt assemblies 23 so that element 21 may be secured to support 19 of block head 15 as previously described herein. Blade portion 27 is provided with a pair of open slots 33 of elongate configuration and spaced from each other. As more clearly shown in FIG. 6, each slot 33 is defined by a pair of opposed parallel sidewalls 35 and a semicircular-shaped bottom 37 which collectively define a U-shaped 29 is also provided with a pair of spaced open slots 39, each of which having the same corresponding configuration as slot 33, but of shorter length.

Figure 4:
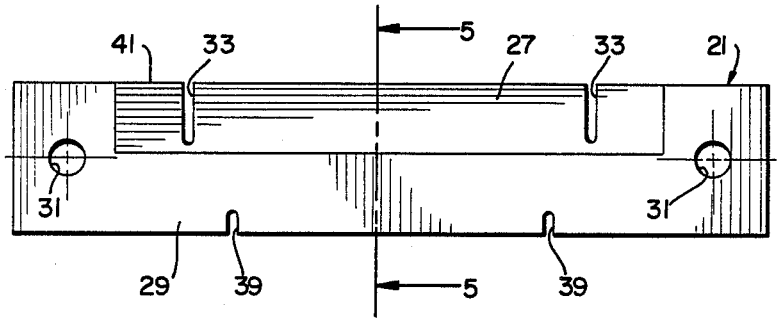
FIG 4 PRIOR ART
FIG. 4 is a front elevation view of a knife element used in the knife assembly of FIGS. 2 and 3.

As apparent from FIG. 3, knife elements 21, though of the same basic configuration as shown in FIG. 4, nevertheless do differ in certain respects. The spacings between slots 33 and slots 39 become progressively narrower from the upstream end of assembly 1 towards the downstream end thereof. Moreover, knife elements 21 positioned at the leading or upstream end of assembly 1 are only provided with slots 39 in their base portions 29, while knife elements 21 positioned at the trailing or downstream end of assembly 1 are only provided with slots 33 in their blade portions 27. Otherwise, the overall size, positioning of apertures 31 and location of blade portion 27 relative to base portion 29 are the same for all knife elements 21 forming assembly 1. With respect to blade portion 27, it is shown in FIG. 5 that a cutting edge 41 of blade portion 27 is formed by at least a single bevel on only one side thereof.

Figure 7:
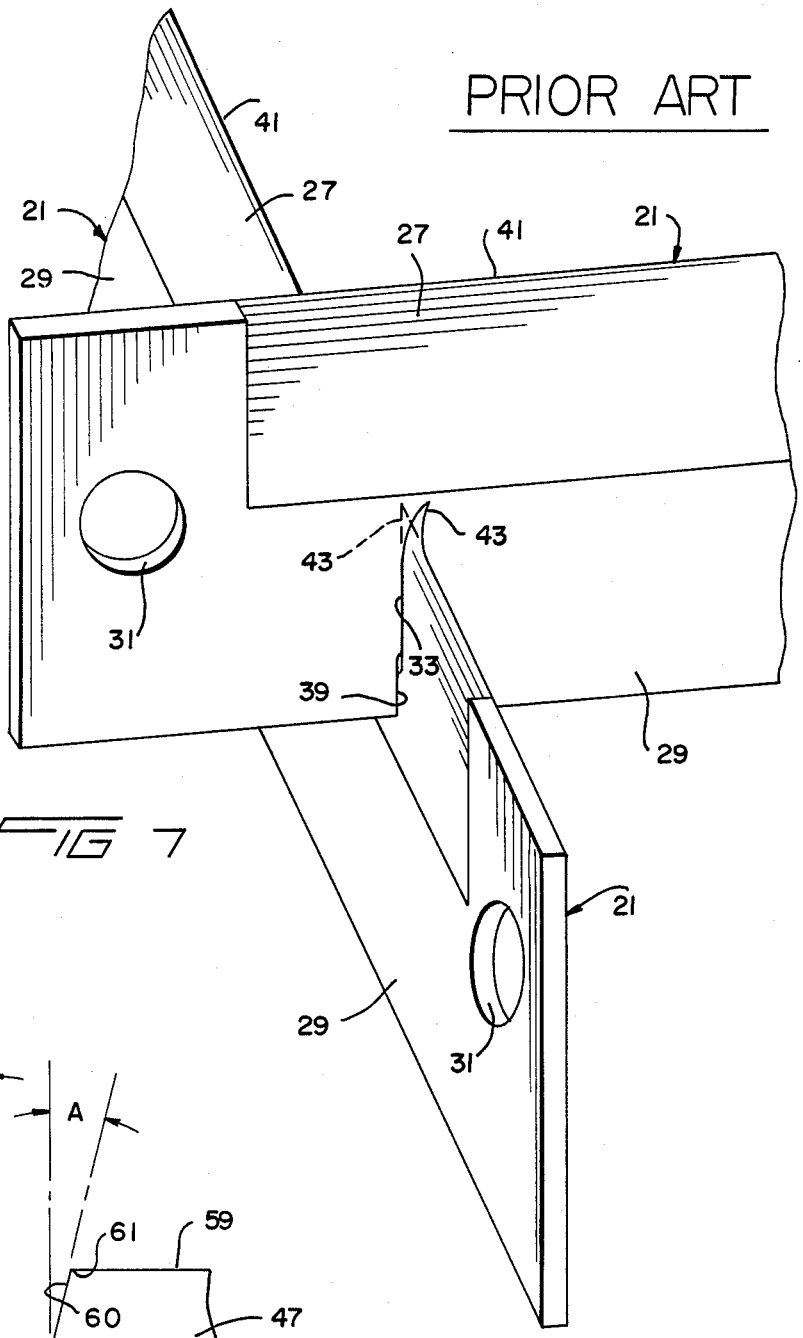
FIG. 7 is a fragmentary perspective view showing two conventional knife elements interengaged with each other, and particularly depicting a bent cutting edge corner portion of a slot in the blade portion of one element caused by the twisting of the other element during the cutting operation.

The manner in which knife elements 21 are interengaged with each other shall now be described with reference to FIG. 7. As seen therein, slot 39 provided in base portion 29 of one knife element 21 is engaged within a corresponding slot 33 provided in blade portion 27 of the other knife element 21. In this position, blade portions 27 of both knife elements 21 face the upstream end of knife assembly 1 for engagement by moving product 5 to be sliced. Due to the fact that a given product 5 does not always approach knife assembly 1 at the central portion thereof and the fact that product 5 is often of an asymmetrical configuration, a twisting of knife elements 21 therefore results during the cutting operation. When this occurs, base portion 29 of one element 21 imparts stress to a pair of cutting edge corner portions 43 of each slot 33 provided in each blade portion 27 of the other element 21. Since blade portion 27 is quite thin at this region, corner portions 43 are therefore caused to bend as shown in FIG. 7. This distorts the otherwise linear configuration of cutting edge 41 and causes tearing of strips 9 being cut from product 5. This problem has heretofore been almost inevitable with conventional knife elements 21 of the type described herein and results in not only poor product quality, but also difficulty in maintenance and reduced longevity of knife elements 21.

Figure 8:
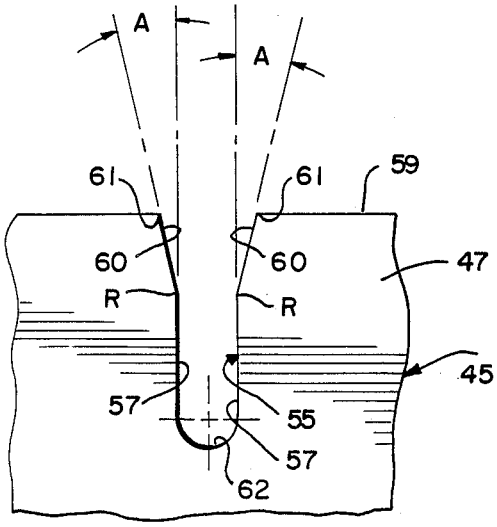
FIG. 8 is a fragmentary view showing a knife element according to a preferred embodiment of the invention, and particularly depicting the outwardly diverging configuration of an open slot in the blade portion of the element.
Figure 9:
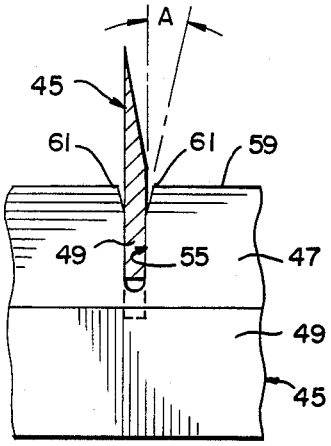
FIG. 9 is a fragmentary view showing the knife element of FIG. 8 interengaged within a corresponding open slot in the base portion of an adjacent knife element.
Figure 10:
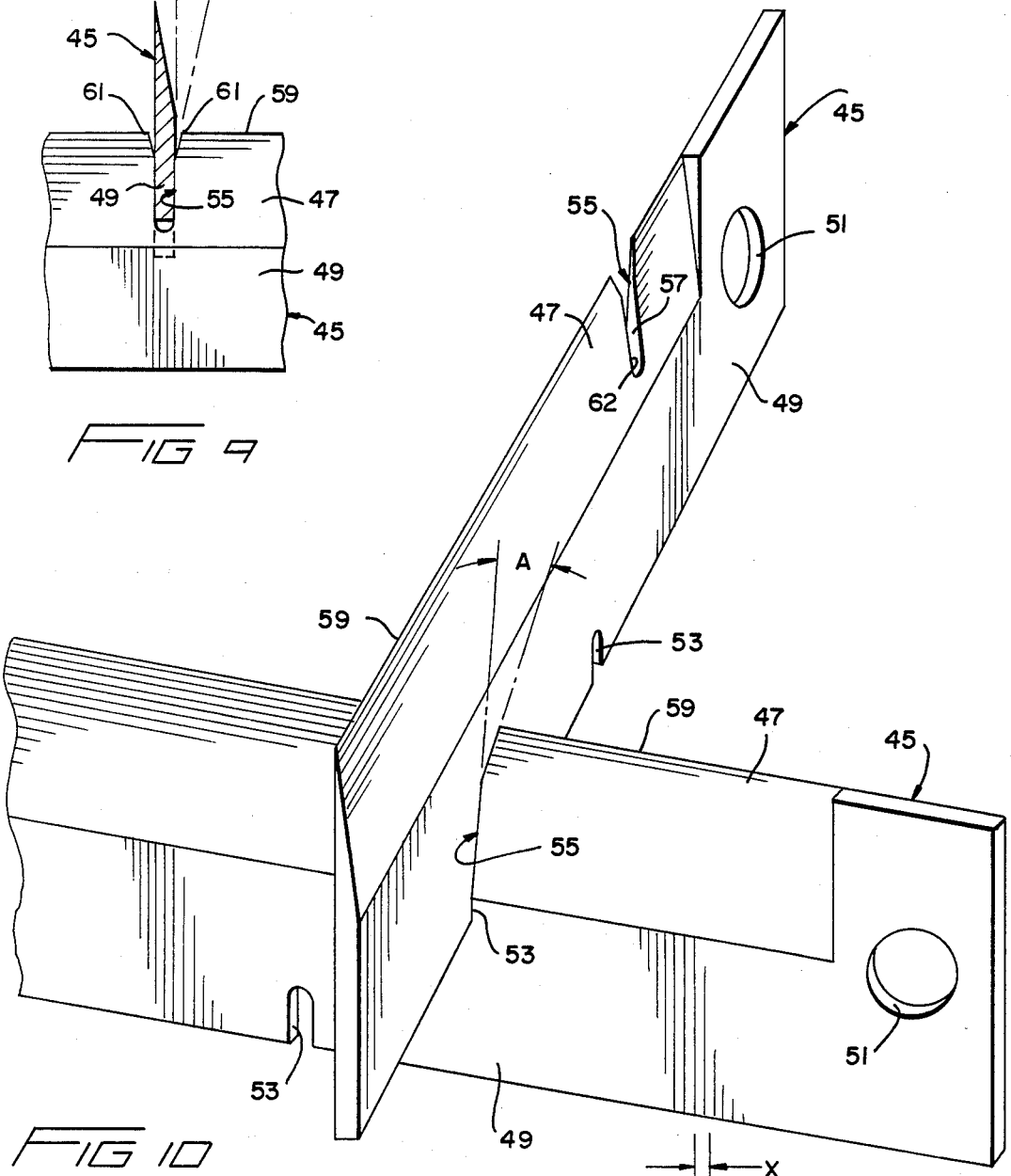
FIG. 10 is a fragmentary perspective view showing two interengaged knife elements according to the invention.

The manner in which the present invention overcomes the aforediscussed problems and disadvantages of known knife elements 21 shall now be described with particular reference to FIGS. 8–10. An improved knife element 45 according to a preferred embodiment of the invention is shown as being provided with a blade portion 47, a base portion 49 and an aperture 51 at each end of element 45. Base portion 49 also includes a pair of spaced slots 53 that are similar in configuration and function as slots 39 of previously described knife element 21. Blade portion 47 is also provided with a pair of spaced slots 55, though only a single slot 55 is depicted in FIGS. 8–10 for each element 45. As particularly shown in FIG. 8, slot 55 is also open and of a substantially U-shaped configuration. However, unlike slot 33 of previously described knife element 21, a pair of opposed sidewalls 57 of slot 55 do not extend completely in parallel to a cutting edge 59 of blade portion 47, but includes a portion which diverges outwardly towards edge 59. This divergence is formed by bevelling sidewalls 57 to form a pair of straight bevels 60 which in part form a pair of cutting edge corner portions 61 of slot 55. Each bevel 60 forms an angle A from an extension of each parallel sidewall 57. This serves to space corner portions 61 away from corresponding base portion 49 of an interengaged knife element 45, thereby permitting the latter element 45 to twist during the cutting operation without bending corner portions 61. Angle A may vary from 5°–20°, though a preferred range would be from 7°–15°. An actual preferred angle would be approximately 10°.

The point at which each sidewall 57 begins to diverge is dependent upon the size of angle A. This point should be further from closed end 62 of slot 55 as angle A increases, but may be moved closer to a closed end 62 of slot 55 as angle A decreases.

Figure 11:
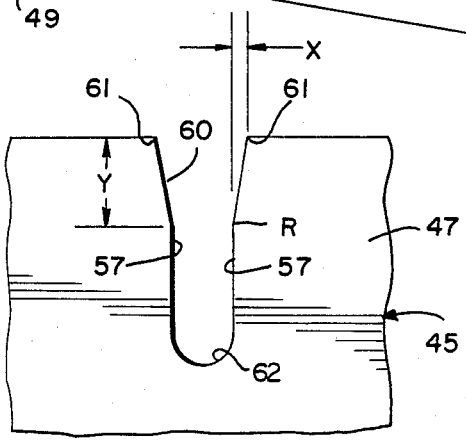
FIG. 11 depicts the fragmentary view of the knife element shown in FIG. 8, particularly detailing the point at which each sidewall of the slot begins to diverge outwardly.

With particular reference to FIGS. 8 and 11, it is shown that this point is defined on both sides of slot 55 by a pair of opposed arcuate or radiused portions as designated at R. The curvature of each portion R serves to distribute stress over a larger area as twisting of an interengaged knife element within slot 55 occurs. At a preferred angle A of 10°, the value of R shall preferably be 0.125 inch. The defining of each point by portion R also significantly facilitates the forming of slot 55 through utilization of a punch and die assembly, since this arcuate or rounded configuration permits the punch and die to remain sharper over a longer period of time. If the point of divergence on either side of slot 55 is defined by sidewall 57 and bevel 60 merging as straight lines, sharp corners will result and promote concentration of stress at the points. Thus, arcuate portions R serve to distribute the pressure and stress of the twisting interengaged knife over broader and stronger areas, and further impart rigidity to the knife element and maintain the twisting interengaged knife element away from the fragile cutting edge corner portions 61. Corner portions 61 thus may be maintained at an optimum distance from the opposed sides of base portion 49 of interengaged knife element 45.

As further noted from FIG. 11, the point of divergence on either side of slot 55 is spaced a distance Y from cutting edge 59. Each corner portion 61 is also spaced a distance X from an extension of each sidewall 57. In a preferred embodiment of the invention wherein angle A is 10°, the value of X is 0.013 inch and the value for Y is 0.085 inch. In the practice of the invention, the value of X may vary from 0.010 inch to 0.050 inch and the value for Y may vary from 0.050 inch to 0.0250 inch.

The determination of the point at which divergence of sidewall 57 occurs may be accomplished in practice by ascertaining the thickness of knife element 45. The divergence should begin at a point wherein knife element 45 has sufficient thickness so as to impart adequate strength against bending or distortion during the twisting of an interengaged knife element within slot 55.

Though straight edge bevels 60 have been depicted for slot 55, it is also possible to diverge slot 55 by using radiused or curved bevels for similar results. The important criteria for practice of the invention is to form corner portions 61 with a sufficient degree of beveling so as to locate corner portions 61 away from physcial contact by base portion 49 of an interengaged knife element 45 when twisting of the latter occurs during the cutting operation.

The invention therefore provides an improved knife element for use in a knife assembly of a water gun whereby the assembly shall always provide uniform quality in the cut product notwithstanding the manner in which the product approaches the assembly. In the event the product does not impact centrally against the knife assembly, any resulting twisting of the knife elements shall not cause bending of the corresponding cutting edge corner portions of adjacent knives. Accordingly, the individual knife elements shall experience longevity in use, ease of maintenance during sharpening, and the ability to consistently produce a sliced product having uniform high quality.

It is to be understood that the forms of the invention herein shown and described are to be taken as merely preferred embodiments of the same, and that various changes in shape, material, size and arrangement of parts may be resorted to without departing from the spirit of the invention or scope of the subjoined claims.

We claim:

1. A knife element for the knife assembly of a water gun, which element comprises:

(a) a rectangular-shaped elongate member defined by a longitudinal base portion and a blade portion having a longitudinal cutting edge;

(b) the blade portion including at least one transversely extending elongate slot of a substantially U-shaped configuration formed by a closed bottom, a pair of longitudinal sidewalls, and an open top defined by a pair of opposed cutting edge corner portions;

(c) each sidewall including a parallel portion extending from the bottom of the slot and terminating at a point short of the cutting edge, and a diverging portion extending from the termination point to the cutting edge; and (d) each diverging portion diverging outwardly from its termination point at an angle sufficient to position it corresponding corner portion away from the base portion of an adjacent knife element interengaged within the slot to prevent the corner portion from being deformed when the adjacent knife element undergoes twisting during cutting of a product by the knife assembly.

2. The knife element of claim 1 wherein each diverging portion is defined by a straight bevel diverging outwardly at an angle of approximately 5°–20° from its corresponding parallel portion.

3. The knife element of claim 2 wherein the angle is approximately 7°–15°.

4. The knife element of claim 3 wherein the angle is approximately 10°.

5. The knife element of claim 4 wherein each termination point is defined by an acrucate portion having a radius of approximately 0.125 inch.

6. The knife element of claim 1 wherein each termination point is spaced inwardly approximately 0.050–0.250 inch from the cutting edge and each corner portion is spaced outwardly approximately 0.010–0.050 inch from its corresponding parallel portion.

7. The knife element of claim 1 wherein the diverging portions are defined by a pair of curved edges.

8. The knife element of claim 1 wherein the diverging portions are defined by a pair of radiused edges.

9. An improved knife assembly for a water gun system, the knife assembly being of the type wherein a plurality of knife elements are mounted in a staggered and 90° offset relationship in a cutting head block, each knife element being an elongate member defined by a longitudinal base portion and a blade portion having a longitudinal cutting edge, the majority of knife elements being provided in its blade portion with at least one transversely extending elongate slot of a substantially U-shaped configuration formed by a closed bottom, a pair of longitudinal sidewalls, and an open top defined by a pair of opposed cutting edge corner portions, the improvement comprising:

(a) each sidewall including a parallel portion extending from the bottom of the slot and terminating at a point short of the cutting edge, and a diverging portion extending from the termination point to the cutting edge; and (b) each diverging portion diverging outwardly from its termination point at an angle sufficient to position its corresponding corner portion away from the base portion of an adjacent knife element interengaged within the slot to prevent the corner portion from being deformed when the adjacent knife element undergoes twisting during cutting of a product by the knife assembly.

10. The knife assembly of claim 9 wherein each diverging portion is defined by a straight bevel diverging outwardly at an angle of approximately 5°–20° from its corresponding parallel portion.

11. The knife assembly of claim 10 wherein the angle is approximately 7°–15°.

12. The knife assembly of claim 11 wherein the angle is approximately 10°.

13. The knife assembly of claim 12 wherein each termination point is defined by an arcuate portion having a radius of approximately 0.125 inch.

14. The knife assembly of claim 9 wherein each termination point is spaced inwardly approximately 0.050–0.250 inch from the cutting edge and each corner portion is spaced outwardly approximately 0.010–0.050 inch from its corresponding parallel portion.

15. The knife assembly of claim 9 wherein the diverging portions are defined by a pair of curved edges.

16. The knife assembly of claim 9 wherein the diverging portions are defined by a pair of radiused edges.

* * * * *

UNITED STATES PATENT AND TRADEMARK OFFICE

CERTIFICATE OF CORRECTION

PATENT NO. : 4,766,793

DATED : August 30, 1988

INVENTOR(S) : Fischer et al.

It is certified that error appears in the above—identified patent and that said Letters Patent is hereby corrected as shown below:

IN THE SPECIFICATION:

Column 3, line 21, delete "mixturee", and insert therefor:
-- mixture --;

Column 4, line 25, after "U-shaped", and line 26, before "29", insert:
-- configuration for slot 33. Similarly, base portion --;

IN THE CLAIMS:

Claim 5, line 2, delete "acrucate", and insert therefor:
-- arcuate --;

Claim 9, line 4, delete "in", and insert therefor:
-- on --.

Signed and Sealed this

Seventh Day of March, 1989

*Attest:*

DONALD J. QUIGG

*Attesting Officer*

*Commissioner of Patents and Trademarks*